US005726142A

United States Patent [19]

Partee et al.

[11] Patent Number: 5,726,142

[45] Date of Patent: Mar. 10, 1998

[54] DETERGENT HAVING IMPROVED PROPERTIES AND METHOD OF PREPARING THE DETERGENT

[75] Inventors: Terrell L. Partee, Scottsdale; Charles Varker, Phoenix; Elaine T. Morse, Mesa, all of Ariz.

[73] Assignee: The Dial Corp, Phoenix, Ariz.

[21] Appl. No.: 544,434

[22] Filed: Nov. 17, 1995

[51] Int. Cl.[6] ..... C11D 3/10; C11D 3/37; C11D 11/00

[52] U.S. Cl. ..... 510/276; 510/351; 510/356; 510/361; 510/443; 510/444; 510/452; 510/478; 510/495; 510/497; 510/509

[58] Field of Search ..... 252/89.1, 174, 252/174.23, 174.24; 510/438, 276, 443, 444, 452, 351, 361, 356, 509, 478, 495, 497

[56] References Cited

U.S. PATENT DOCUMENTS

| | | | |
|---|---|---|---|
| 3,207,694 | 9/1965 | Gogek | 252/105 |
| 3,503,885 | 3/1970 | Langenfeld | 252/105 |
| 3,700,601 | 10/1972 | Hilden | 252/105 |
| 3,741,901 | 6/1973 | Ziffer | 252/89 |
| 4,028,282 | 6/1977 | Okumura et al. | 252/537 |
| 4,147,649 | 4/1979 | Arnau et al. | 252/559 |
| 4,155,882 | 5/1979 | Davies et al. | 252/548 |
| 4,203,858 | 5/1980 | Chakrabarti | 252/135 |
| 4,238,345 | 12/1980 | Guilbert | 252/174.12 |
| 4,243,543 | 1/1981 | Guilbert et al. | 252/105 |
| 4,280,919 | 7/1981 | Stoeckigt et al. | 252/135 |
| 4,289,644 | 9/1981 | Steinhauer et al. | 252/127 |
| 4,295,985 | 10/1981 | Petrow et al. | 252/105 |
| 4,299,739 | 11/1981 | Esposito et al. | 252/545 |
| 4,412,934 | 11/1983 | Chung et al. | 252/186.38 |
| 4,414,130 | 11/1983 | Cheng | 252/140 |
| 4,446,042 | 5/1984 | Leslie | 252/102 |
| 4,473,485 | 9/1984 | Greene | 252/174.12 |
| 4,474,678 | 10/1984 | Lutz et al. | 252/174.21 |
| 4,477,372 | 10/1984 | O'Lenick | 252/545 |
| 4,515,705 | 5/1985 | Moeddel | 252/174.12 |
| 4,530,781 | 7/1985 | Gipp | 252/546 |
| 4,550,862 | 11/1985 | Barker et al. | 222/109 |
| 4,564,463 | 1/1986 | Secemski et al. | 252/174.17 |
| 4,581,229 | 4/1986 | Petrow | 424/70 |
| 4,595,527 | 6/1986 | Gipp | 252/546 |
| 4,671,886 | 6/1987 | Mueller | 252/140 |
| 4,681,592 | 7/1987 | Hardy et al. | 8/111 |
| 4,715,979 | 12/1987 | Moore et al. | 252/91 |
| 4,741,854 | 5/1988 | Krupa et al. | 252/105 |
| 4,764,302 | 8/1988 | Baker et al. | 252/301.23 |
| 4,786,440 | 11/1988 | Cooper et al. | 252/546 |
| 4,797,225 | 1/1989 | Broz et al. | 252/105 |
| 4,803,008 | 2/1989 | Ciolino et al. | 252/162 |
| 4,820,441 | 4/1989 | Evans et al. | 252/174.18 |
| 4,853,259 | 8/1989 | Taha | 427/221 |
| 4,861,503 | 8/1989 | Hollingsworth et al. | 252/135 |
| 4,880,601 | 11/1989 | Andermann et al. | 422/28 |
| 4,882,074 | 11/1989 | Kenyon et al. | 252/8.8 |
| 4,891,147 | 1/1990 | Gray et al. | 252/104 |
| 4,900,466 | 2/1990 | Atkinson et al. | 252/174.14 |
| 4,908,215 | 3/1990 | Perlman | 424/661 |
| 4,919,847 | 4/1990 | Barletta et al. | 252/558 |
| 4,968,451 | 11/1990 | Scheibel et al. | 252/549 |
| 4,970,029 | 11/1990 | Halas | 252/549 |
| 4,976,921 | 12/1990 | Itagaki et al. | 422/28 |
| 4,988,454 | 1/1991 | Eertink et al. | 252/140 |
| 5,002,684 | 3/1991 | Beck et al. | 252/105 |
| 5,009,804 | 4/1991 | Clayton et al. | 252/90 |
| 5,017,301 | 5/1991 | Bean et al. | 252/105 |
| 5,019,289 | 5/1991 | Gray et al. | 252/95 |
| 5,024,782 | 6/1991 | Finn et al. | 252/174.13 |
| 5,035,825 | 7/1991 | Eckhardt et al. | 252/95 |
| 5,108,646 | 4/1992 | Beerse et al. | 252/174.25 |
| 5,169,455 | 12/1992 | Kessler | 134/42 |
| 5,178,798 | 1/1993 | Jolicoeur | 252/553 |
| 5,194,639 | 3/1993 | Connor et al. | 554/66 |
| 5,205,960 | 4/1993 | Kristopeit et al. | 252/174.24 |
| 5,268,002 | 12/1993 | Olson et al. | 8/107 |
| 5,288,431 | 2/1994 | Huber et al. | 252/548 |
| 5,302,310 | 4/1994 | Houghton | 510/509 |
| 5,318,714 | 6/1994 | Markussen et al. | 252/95 |
| 5,364,789 | 11/1994 | Guinn et al. | 435/262.5 |
| 5,366,509 | 11/1994 | Ota et al. | 8/108.1 |
| 5,366,510 | 11/1994 | Wasinger et al. | 8/110 |
| 5,366,652 | 11/1994 | Capeci et al. | 252/89.1 |
| 5,376,300 | 12/1994 | Bolkan et al. | 252/174.14 |
| 5,389,277 | 2/1995 | Prieto | 252/99 |
| 5,391,326 | 2/1995 | Smith et al. | 252/559 |
| 5,415,806 | 5/1995 | Pepe et al. | 252/174.21 |
| 5,425,898 | 6/1995 | Phillippi et al. | 252/301.23 |
| 5,482,646 | 1/1996 | Mazzola | 510/509 |
| 5,547,603 | 8/1996 | Sörensson et al. | 510/509 |
| 5,569,645 | 10/1996 | Dinniwell et al. | 510/276 |

FOREIGN PATENT DOCUMENTS

| | | |
|---|---|---|
| 63264/90 | 1/1990 | Australia . |
| 0 080 222 A | 6/1983 | European Pat. Off. . |
| 2 500 475 A | 8/1982 | France . |
| 2 203 751 | 10/1988 | United Kingdom . |
| 2 221 694 | 2/1990 | United Kingdom . |
| 91 02047 A | 2/1991 | WIPO . |
| 92 07932 A | 5/1992 | WIPO . |
| 93/00419 | 1/1993 | WIPO . |

OTHER PUBLICATIONS

RD 36640, "High Density Detergent Composition Containing Spray–Dried Granules and Agglometrates", Research Disclosure, Oct. 1994.

*Primary Examiner*—Paul Lieberman
*Assistant Examiner*—Lorna M. Douyon
*Attorney, Agent, or Firm*—Snell & Wilmer L.L.P.

[57] ABSTRACT

A detergent having improved properties is provided. In accordance with preferred embodiments, a carbonate built detergent comprising an agglomerateed admixture of a base granular formulation and a detergent agglomerate is provided. The base granular composition comprises a carrier together with a copolymer which serves to improve anti-encrustation and anti-redeposition properties of the detergent. A method of preparing the improved detergent composition is also provided.

10 Claims, No Drawings

DETERGENT HAVING IMPROVED PROPERTIES AND METHOD OF PREPARING THE DETERGENT

TECHNICAL FIELD

The present invention relates, generally, to laundry detergents, and more particularly, to laundry detergents having improved anti-encrustation properties.

BACKGROUND OF THE PRESENT INVENTION

Laundry detergents are, of course, well known. As is also well known, in use, such detergents often leave a residue on the items washed in water containing the detergent. In the case of clothing items, this encrustation can result in a loss of softness of the article and the corresponding loss of comfort for the user.

In addition, and as is also well known, the dirty wash liquor and mineral encrustation can, unless inhibited, redeposit on the clothes tending to create unsightly films. After several washes, particularly in the case of colored clothing items, such redeposition can result in fading or other loss of color in such clothing items.

While many attempts have been made to improve laundry detergent anti-encrustation and anti-redeposition properties, none have satisfactorily accomplished that objective, particularly in the context of general heavy-duty laundry detergents. The present invention addresses this long felt yet unresolved need.

SUMMARY OF THE INVENTION

In accordance with a preferred embodiment of the present invention, a laundry detergent comprises an agglomerated admixture of a base granular formulation and a detergent agglomerate. In accordance with a preferred aspect of this embodiment, a colorant is also admixed.

Preferably, the base granular composition comprises a carrier together with a copolymer which serves to improve anti-encrustation and anti-redeposition properties of the detergent. Preferably the copolymer comprises an alkali metal salt of a polyacrylic acid, polymethacrylic acid or copolymer of acrylic and methacrylic acids, and evidences a molecular weight preferably in the range of about 2,000 to about 5,000 and more preferably in the range of about 2,000 to about 4,000. Preferably, the copolymer is used in the context of the detergent as well as in the context of being part of the admixture used or blended into the detergent.

In accordance with a further aspect of the present invention, preferably, the base granular composition is spray-dried in a conventional fashion and then admixed with a detergent agglomerate.

DETAILED DESCRIPTION OF PREFERRED EXEMPLARY EMBODIMENTS

Preferred exemplary embodiments of the present invention will hereafter be described in conjunction with the description that follows. It will be understood that such detail is for illustration purposes only and that the subject invention is not so limited.

While the specific formulations of detergent within the present invention will be described in greater detail hereinbelow, in general, a detergent formulation in accordance with the present invention comprises a base detergent including an alkali metal carbonate and a copolymer, and an agglomerated admix. Preferably, the base detergent and copolymer are spray dried, in a conventional fashion, and thereafter admixed in a blending formulation including the detergent agglomerate.

In general, the blending formulation comprises about 50 to about 95 wt % of the base detergent and about 5 to about 45 wt % of the agglomerated admix, the remainder comprising conventional detergent additives. In accordance with a first embodiment, the blending formulation preferably comprises about 50 to about 65 wt %, more preferably about 52 to about 57 wt %, and optimally about 55 wt % of the base detergent granular, and preferably about 25 to about 45 wt %, more preferably about 30 to about 40 wt %, and optimally about 33 wt % of the detergent agglomerate. In accordance with a second embodiment, the blending formulation preferably comprises about 65 to about 95 wt %, more preferably about 75 to about 90 wt %, and optimally about 89 wt % of the base detergent granular, and preferably about 5 to about 25 wt %, more preferably 7 to about 15 wt % and optimally about 9 wt % of the detergent agglomerate.

Preferably the base detergent formulation comprises, in addition to the alkali metal carbonate (e.g. sodium carbonate) an anionic surfactant and an inert diluent. Suitable anionic surfactants include alkyl, alkylaryl or alkenyl sulfonates and alkyl and alkylene ethoxysulfates. A preferred anionic surfactant comprises an alkyl sulfonate present in an amount of up to about 40 wt %, preferably of about 8 to about 35 wt %. Sodium dodecylbenzenesulfonate is particularly preferred.

The inert diluent preferably comprises an alkali metal chloride, sulfate, nitrate and/or the like. For example, a preferred diluent comprises sodium chloride, sodium sulfate and/or mixtures thereof.

Preferably, the alkali metal carbonate, for example sodium carbonate, is present in an amount of up to about 50 wt %.

The base detergent also includes a copolymer, preferably having a molecular weight in the range of about 2,000 to about 5,000, more preferably between about 2,000 and about 3,000. The copolymer preferably is present in an amount of up to about 5 wt %, more preferably between about 1 and about 4 wt %.

The base detergent may include other conventional additives such as whitening agents, anti-caking agents and/or other similar adjuvants. Each of these adjuvants may be added in conventional amounts.

Preferably, the agglomerated admix comprises a nonionic surfactant and a builder. Suitable nonionic surfactants include primary and secondary ethoxylated alcohols and the like. Preferably, such ethoxylates have about 2 to about 15 moles of ethylene oxide per mole of alcohol. Suitably the builder comprises an alkali metal carbonate, for example, sodium carbonate. Optional additives such as anti-caking agents and the like may also be incorporated into the admix.

In accordance with one aspect of the present invention, all or a portion of the polymeric additive (i.e. the aforementioned copolymer) may also be contained in the agglomerate. In such case, the copolymer is present in the agglomerate at amounts similar to those discussed hereinabove, for example, on the order of up to about 5.0 wt %.

Preferably a slurry comprising the base detergent ingredients is spray-dried and admixed with the agglomerate in a blending formulation which may also include whitening agents (e.g. fluorescent whitening agents), alkalinity agents (e.g. alkali metal silicates), perfumes and/or colorants. Optional additional ingredients, such as foam control agents, processing aids, stain removal agents and other performance agents may also be utilized either in the blending formulation, the base detergent formulation or agglomerate as desired.

Preferably, the detergents in accordance with the present invention comprise low to moderate density, general, heavy-duty laundry detergent powders. In accordance with a preferred aspect of the present invention, the pour density of the finished product is preferably less than about 900 g/l, more preferably in the range of about 400 g/l. The detergents in accordance with the present invention have been found to be particularly well-suited for a broad range of applications, for example, ranging from gentle cleaning powder detergents to general heavy-duty laundry powder detergents. In accordance with these aspects of the present invention, not only are anti-redeposition properties enhanced, but the flame retardancy of such articles tends to be retained.

In accordance with first and second embodiments of the present invention, as set forth Formulations 1 and 2 below respectively, the detergent comprises a base granular composition, preferably formed by a conventional spray drying process, which comprises, in weight percent, the following components:

| | Formulation 1 | Formulation 2 |
|---|---|---|
| Sodium chloride | 40.61 | 43.18 |
| Sodium carbonate | 15.00 | 34.59 |
| Sodium silicate[1] | 5.50 | 4.50 |
| Sodium dodecylbenzene sulfonate | 32.54 | 14.90 |
| Sodium polyacrylate | 3.62 | 1.41 |
| Stilbene whitening agent | 1.27 | 0.29 |
| Sodium sulfate[2] | 0.46 | 0.13 |
| Water | 1.00 | 1.00 |

[1]having a ratio of solids of about 1:1.8
[2]from the spray dried slurry

The stilbene whitening agents suitable for use within the context of the present invention include the cyanuric chloride/diaminostilbene disulfonic acid (CC/DAS) type whiteners. For example, preferable whitening agents comprise TINOPAL® AMS-GX, available from CIBA-GEIGY Corporation of Greensboro, N.C., Blancophor DML SV2447 available from Mobay Chemical Corp. of Pittsburgh, Pa. and/or mixtures thereof.

The base bead composition is preferably admixed with a detergent agglomerate having between 13 and about 18% of a nonionic surfactant, and preferably about 15% of a nonionic surfactant. Preferably the nonionic comprises a primary or secondary alcohol ethoxylate, such as a linear alcohol ethoxylate having a molecular weight in the range of 650 to 750, more preferably in the range of about 668 to about 703 and an EO content (weight percent) in the range of about 65 to about 75. Particularly preferred ethoxylates of this type include those of the general formula:

$$R—O—(CH_2CH_2O)_{13}—H$$

Where R is a blend of primary (linear) alcohols having between 12 and 16 carbons, preferably about 66% $C_{12}$, 27% $C_{14}$ and 6% $C_{12}$ alcohols. One such commercially available ethoxylate of this formula comprises SURFONIC® L24-12 surfactant available from Huntsman Corporation of Houston, Tex. having a molecular weight of about 703 and an EO content (wt %) of about 71.9. (SURFONIC is a registered trademark of the Huntsman Corporation.)

Other preferred ethoxylates include those of the general formula:

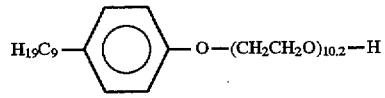

For example, ethoxylates generally referred to under the generic name Nonoxynol-10 typically fall within this category. A particularly preferred ethoxylate of this formula comprises SURFONIC® N-102 Surfactant also available from Huntsman Corporation of Houston, Texas having a molecular weight of about 668 and an EO content (wt %) of about 67.1.

Preferably, the agglomerate also comprises anti-caking agents and builders. A preferable anticake agent comprises sodium silicate and a preferable builder comprises sodium carbonate.

A particularly preferred detergent agglomerate includes between about 65 and about 85 wt %, preferably about 75 wt % sodium carbonate, and between 13 and about 18 wt %, preferably about 15 wt % nonionic which evidences a bulk density of between about 730 and about 830 g/l.

In accordance with one aspect of the present invention, the detergent composition may optionally include a colorant composition. For example, the colorant composition may comprise a pink colorant composition having the following components, all listed in weight percent:

| | |
|---|---|
| Primary alcohol ethoxylate | 87.50 |
| Red pigment | 5.00 |
| $TiO_2$ | 7.50 |

The primary alcohol ethoxylate may be of the form previously discussed hereinabove or any other suitable ethoxylate. It should be appreciated that other colorants may also be used, if desired, in the context of the present invention.

In accordance with preferred aspects of the present invention the base bead composition, the agglomerated admix and the colorant composition, if any, are blended together in a blending formula which preferably also includes anti-cake agents, bleaching agents and perfumes. Two particularly preferred blending formulations, corresponding to the Formulations 1 and 2 above, with each of the components set forth in weight percent, are as follows:

| | Formulation 1 | Formulation 2 |
|---|---|---|
| Base bead | 55.16 | 88.61 |
| Agglomerated admix | 33.33 | 9.13 |
| Colorant composition | 0.11 | 0.00 |
| Sodium percarbonate | 10.50 | 0.00 |
| Sodium perborate | 0.00 | 1.25 |
| Inorganic filler | 0.90 | 0.50 |
| Perfume | 0.24 | 0.26 |

As will be appreciated, in the context of the foregoing blending formulations the percarbonate and perborate comprise preferred bleaching agents; other bleaching agents, however may also be employed. Moreover, the inorganic fillers may comprise silicates and the like. Further, in general, the perfume may comprise any perfume or other fragrance additive as are or may hereafter be devised for use in (or omitted from) the detergents in accordance with the present invention.

As previously briefly mentioned hereinabove, in accordance with a preferred aspect of the present invention, the base granular composition is formed in a slurry which is spray-dried, and thereafter dry blended with the agglomerate, colorant, etc. to arrive at the final dry, particulate detergent.

Two particularly preferred final compositions (i.e. Formulations 1 and 2) in accordance with the present invention include the following components, all of which are listed in weight percent:

| | Formulation 1 | Formulation 2 |
|---|---|---|
| Sodium chloride | 25.45 | 38.25 |
| Sodium carbonate | 4.47 | 30.65 |
| Sodium carbonate[1] | 25.00 | 6.85 |
| Sodium silicate | 3.04 | 3.99 |
| Sodium silicate[1] | 2.33 | 0.64 |
| Sodium dodecylbenzenesulfonate | 18.00 | 13.20 |
| Primary alcohol ethoxylate[1] | 5.00 | 1.37 |
| Sodium polyacrylate | 2.00 | 1.25 |
| Fluorescent whitening agent | 0.70 | 0.26 |
| Sodium sulfate[2] | 0.70 | 0.12 |
| Water[1] | 1.00 | 0.27 |
| Water | 0.56 | 0.89 |
| Perfume | 0.24 | 0.26 |
| Sodium percarbonate | 10.50 | 0.00 |
| Sodium perborate | 0.00 | 1.25 |
| Primary alcohol ethoxylate[3] | 0.107 | 0.25 |
| Red pigment[3] | 0.001 | 0.00 |
| $TiO_2$[3] | 0.002 | 0.00 |
| Synthetic magnesium silicate | 0.90 | 0.50 |

[1]from the agglomerate
[2]from the slurry
[3]from the colorant composition

It should be appreciated that while Formulations 1 and 2 are set forth in an illustrative manner herein, other detergent formulations having similar compositions or compositions generally between those of Formulations 1 and 2 are within the scope of the present invention.

In accordance with a preferred aspect of the present invention, and as described hereinabove, the detergent compositions according to the present invention preferably incorporate a polymeric component which aids in preventing redeposition of the dirty wash liquor on the items washed/cleaned with the detergent. Preferably, as briefly mentioned above, the copolymer has an average molecular weight in the range of about 2,000 to about 3,000. Preferably, the copolymer is comprised of an alkali metal salt of polyacrylic acid, polymethacrylic acid or a copolymer of acrylic and methacrylic acids, having a molecular weight in the range of about 2,000 to about 5,000, preferably about 2,000 to about 4,500, and more particularly about 2,000 to about 3,000. Preferably the polyacrylate has a pH in the range of about 5.0 to about 9.0, and more preferably about 5.0 to about 7.0. One particularly preferred polyacrylate comprises Polymer X-0125-BJ-76 available from Rhone-Poulenc of Cranbury, N.J.

The present inventors have found that detergents made in accordance with the present invention evidence improvements in inhibiting encrustation and redeposition over repeated use. Stated another way, the detergents of the present invention enable good cleaning while significantly reducing the deposition of minerals and/or soil to maintain fabric softness and appearance.

To evidence the improved performance characteristics of the detergents according to the present invention, tests have been conducted to determine the presence of residues left on clothes washed with the detergents of the present invention, the softness of such articles after washing and the effect of such detergents on color retention of the articles washed. The following Examples reflect such tests.

EXAMPLE 1

Lack of Residues

Similarly sized, colored (navy blue) and content (100% cotton knit) pieces of fabric were washed in a conventional Tergotometer over five (5) cycles. In one case a wash liquor containing an amount of a conventional non-built, mixed active detergent without copolymer addition was used; in the other case an equal amount of a detergent of the composition set forth hereinabove in Formulation A was used. After washing over the five (5) cycles, the fabric samples were evaluated by a multi-member panel for residue on a scale of 0 to 5, with 0 being reflective of no residue, 1 being reflective of slight residue, 2 being reflective of low residue, 3 being reflective of moderate residue, 4 being reflective of heavy residue and 5 being reflective of very heavy residue. The samples were evaluated and the scores averaged. The samples washed with the conventional detergent were evaluated as exhibiting a heavy to very heavy residue (4.50) whereas the samples washed in a detergent in the form of Formulation A exhibited only low to moderate residue (2.50).

EXAMPLE 2

Enhanced Softness

The fabric samples used in Example 1 were also evaluated by the panel for softness by comparing the respective washed samples to unwashed fabric samples (i.e. a control) and evaluating them on a softness scale of 1 to 5 with 1 indicating that the test sample was much softer than the control, 2 indicating the test sample was slightly softer than the control, 3 indicating the test sample was equally as soft as the control, 4 indicating the test sample was slightly rougher than the control, and 5 indicating the test sample was much rougher than the control. The samples washed in the conventional detergent were evaluated as being slightly to much rougher than the control (4.20), whereas the samples washed in the detergent according to the present invention having a composition of that set forth above in Formulation A were about as soft as the control or slightly rougher (3.70).

EXAMPLE 3

Improved Color Retention

The fabric samples used in Example 1 were also evaluated by the panel for color retention. The panel compared the respective washed samples against a control unwashed fabric sample. As is generally known encrustation tends to make dark fabrics appear lighter due to the mineral build-up on the fabric, and thus the samples were evaluated on a darkness scale of 1 to 5, with 1 indicating that the sample was much darker than the control, 2 indicating slightly darker than the control, 3 indicating the same color as the control, 4 indicating slightly lighter than the control, and 5 indicating much lighter than the control. The samples washed in the conventional detergent were evaluated by the panel as being generally slightly lighter than the control (3.80), whereas the samples washed in the detergent according to the invention were generally about the same color as the control (3.10), thus evidencing superior color retention.

As should now be appreciated, the detergents in accordance with the present invention evidence enhanced anti-redeposition and anti-encrustation properties as well as improved color retention properties. Such detergents are particularly suited for use in a wide variety of cleaning applications.

It will be understood that the foregoing description is of preferred exemplary embodiments of the present invention, and that the present invention is not limited to the specific examples and compositions set forth herein. Such examples and compositions are for illustrative purposes only. Various modifications may be made in light thereof as will be suggested to persons skilled in the art without departing from the scope of the invention as expressed in the appended claims.

We claim:

1. A laundry detergent composition having improved anti-redeposition properties and having a density of about 400 to less than about 900 g/l consisting essentially of:

about 50 to about 95 wt % of a spray dried slurry of a base detergent composition consisting essentially of about 34–50 wt % of an alkali metal carbonate builder as the sole builder, about 1 to 5 wt % sodium polyacrylate having a molecular weight in the range of about 2,000 to about 3,000, about 8 to 35 wt % of an anionic surfactant and optionally an inert diluent selected from the group consisting of alkali metal chloride, sulfate, nitrate and mixtures thereof;

about 5 to 45 wt % of an agglomerated admix formulation consisting essentially of about 13–18 wt % nonionic surfactant and between about 65 and about 85 wt % of sodium carbonate; and about 0 to about 5 wt % of one or more additives.

2. The laundry detergent composition of claim 1 wherein the sodium polyacrylate is present in an amount of about 1 to about 4 wt % of the laundry detergent composition, and wherein the sodium polyacrylate is a sodium salt of polyacrylic acid, polymethacrylic acid or a copolymer thereof.

3. The laundry detergent composition of claim 2 wherein the sodium polyacrylate is present in an amount of about 1.25 to 2.0 wt. % of the laundry detergent composition.

4. The laundry detergent composition of claim 1 wherein the anionic surfactant is selected from the group consisting of an alkyl sulfonate, an alkylaryl sulfonate, an alkenyl sulfonate, an alkyl ethoxysulfate and an alkylene ethoxysulfate.

5. The laundry detergent composition of claim 4 wherein the anionic surfactant is an alkyl sulfonate.

6. The laundry detergent composition of claim 5 wherein the alkyl sulfonate is dodecylbenzenesulfonate.

7. The laundry detergent composition of claim 1 wherein the inert diluent is sodium chloride, sodium sulfate, or mixtures thereof.

8. The laundry detergent composition of claim 1 wherein the nonionic surfactant is selected from the group consisting of primary and secondary ethoxylated alcohols having about 2–15 moles of ethylene oxide per mole of alcohol.

9. The laundry detergent composition of claim 1 wherein the nonionic surfactant is a linear alcohol ethoxylate having a molecular weight of about 650–750.

10. A method of preparing a laundry detergent composition having a density of about 400 to less than about 900 g/l to prevent redeposition and encrustation consisting essentially of the steps of:

spray drying a base slurry detergent composition consisting essentially of about 1 to 5 wt % of a sodium polyacrylate having a molecular weight in the range of about 2,000 to about 3,000, about 8–35 wt % of an anionic surfactant, and about 34 to 50 wt % of an alkali metal carbonate builder as the sole builder;

providing an agglomerated admix formulation consisting essentially of about 13–18 wt % nonionic surfactant and between about 65 and about 85 wt % of sodium carbonate; and about 0 to about 5 wt % of an additive; and mixing about 50 to about 95 wt % of the base detergent composition with about 5 to about 45 wt % of the agglomerated admix formulation and about 0 to about 5 wt % of the additive to produce a granular detergent.

* * * * *

UNITED STATES PATENT AND TRADEMARK OFFICE

CERTIFICATE OF CORRECTION

PATENT NO. : 5,726,142

DATED : Mar. 10, 1998

INVENTOR(S) : Partee et al.

It is certified that error appears in the above-identified patent and that said Letters Patent is hereby corrected as shown below:

At Column 3, Line 57, please replace "R-O-$(CH_2\ CH_2O)_{13}$" with -- R-O-$(CH_2\ CH_2O)_{12}$-H --

Signed and Sealed this

Twenty-fourth Day of November, 1998

*Attest:*

BRUCE LEHMAN

*Attesting Officer*

*Commissioner of Patents and Trademarks*